United States Patent [19]

Baugh

[11] 3,954,137

[45] May 4, 1976

[54] SUB-SEA WELL RE-ENTRY GUIDANCE APPARATUS

[75] Inventor: Benton F. Baugh, Houston, Tex.

[73] Assignee: Vetco Offshore Industries, Inc.

[22] Filed: Dec. 11, 1974

[21] Appl. No.: 531,706

[52] U.S. Cl. ..... 166/.6; 175/7

[51] Int. Cl.[2] ..... E21B 43/01

[58] Field of Search ..... 175/5, 7; 166/.5, .6

[56] References Cited

UNITED STATES PATENTS

| | | | |
|---|---|---|---|
| 2,909,359 | 10/1959 | Bauer et al. | 175/7 |
| 3,050,140 | 8/1962 | Hayes | 175/7 |
| 3,503,442 | 3/1970 | Dodd et al. | 175/7 X |
| 3,513,909 | 5/1970 | Peterman et al. | 166/.5 |
| 3,517,737 | 6/1970 | Petersen | 175/7 X |
| 3,626,527 | 12/1971 | Brown | 166/.5 X |
| 3,709,291 | 1/1973 | Hanes et al. | 166/.5 |
| 3,710,859 | 1/1973 | Hanes et al. | 166/.6 |

*Primary Examiner*—John E. Murtagh
*Assistant Examiner*—Richard E. Favreau
*Attorney, Agent, or Firm*—Pravel & Wilson

[57] ABSTRACT

A guidance apparatus for re-entering a sub-sea wellhead or christmas tree after the guidelines extending to the water surface have been removed. The apparatus includes a remotely actuated marker buoy secured by a reeled line to an upwardly projecting keyed buoy post at the wellhead and a second upwardly projecting keyed post is positioned near the well centerline adjacent to the buoy post and the wellhead. The apparatus also includes a re-entry funnel adapted to be run from the surface on a cable attached to either post and having an internal cam engageable by the key on the post to orient the re-entry funnel and align any tools carried thereby with respect to the wellhead, tree or other parts of the sub-sea wellhead structure.

14 Claims, 13 Drawing Figures

51a
107
51
110
112
100
106
101
105
103
T
55
60
R
50
35
46
58
45
44
53
43
42
41
31
48
40
40a
34
W
10
11
14
C 200
220
210
197
212
191
191
201
195
215
192
202
190
192

SUB-SEA WELL RE-ENTRY GUIDANCE APPARATUS

BACKGROUND OF THE INVENTION

1. Field Of The Invention

The present invention pertains to a diverless re-entry guidance apparatus which is operated from the water surface for re-entering a sub-sea wellhead or christmas tree after the guidelines have been removed from the permanent guide structure. Such apparatus is used to establish guideline connections to the wellhead or the christmas tree or, if desired, guideline connections may be re-established to the permanent guide posts. Further, with guideline connections re-established, various tools may then be run on the guidelines for re-entering the tree or wellhead to conduct various functions including disconnection and removal of the tree from the wellhead.

2. Description Of The Prior Art

One of the persistent problems encountered in the operation and maintenance of sub-sea wells is that of reentering the wellhead or christmas tree after the guidelines extending upwardly from the permanent guide post to the water surface have been removed. Some of the various re-entry systems currently being used include those of the diver assisted type, either a free diver or in a manned vehicle directed by a buoy line or of the submarine type. Further, there are systems employing sonar for reattaching a guideline. However, all of these systems have a requirement for a diver access or a substantial investment in expendable tools and equipment. The hazards as well as the difficulties encountered in re-entering wells become more severe as the water depth increases and it is, therefore, an object of this invention to provide a relatively simple economic diverless re-entry system for performing various sub-sea re-entry functions in the water.

SUMMARY OF THE INVENTION

The re-entry guidance system of the present invention includes a re-entry funnel adapted to be run on a guideline extending from the water surface to the wellhead. A releasable buoy carries a small line to the surface to provide the initial guideline connections to the well and the re-entry funnel is run on this line to establish a large diameter guideline connection to a re-entry post on the tree structure. Additional guidelines can then be connected to two of the permanent guide posts to provide a guidance system for setting or retrieving a tree and also for running various tools to the wellhead and/or the tree.

DESCRIPTION OF THE PREFERRED EMBODIMENT

Figure 1:
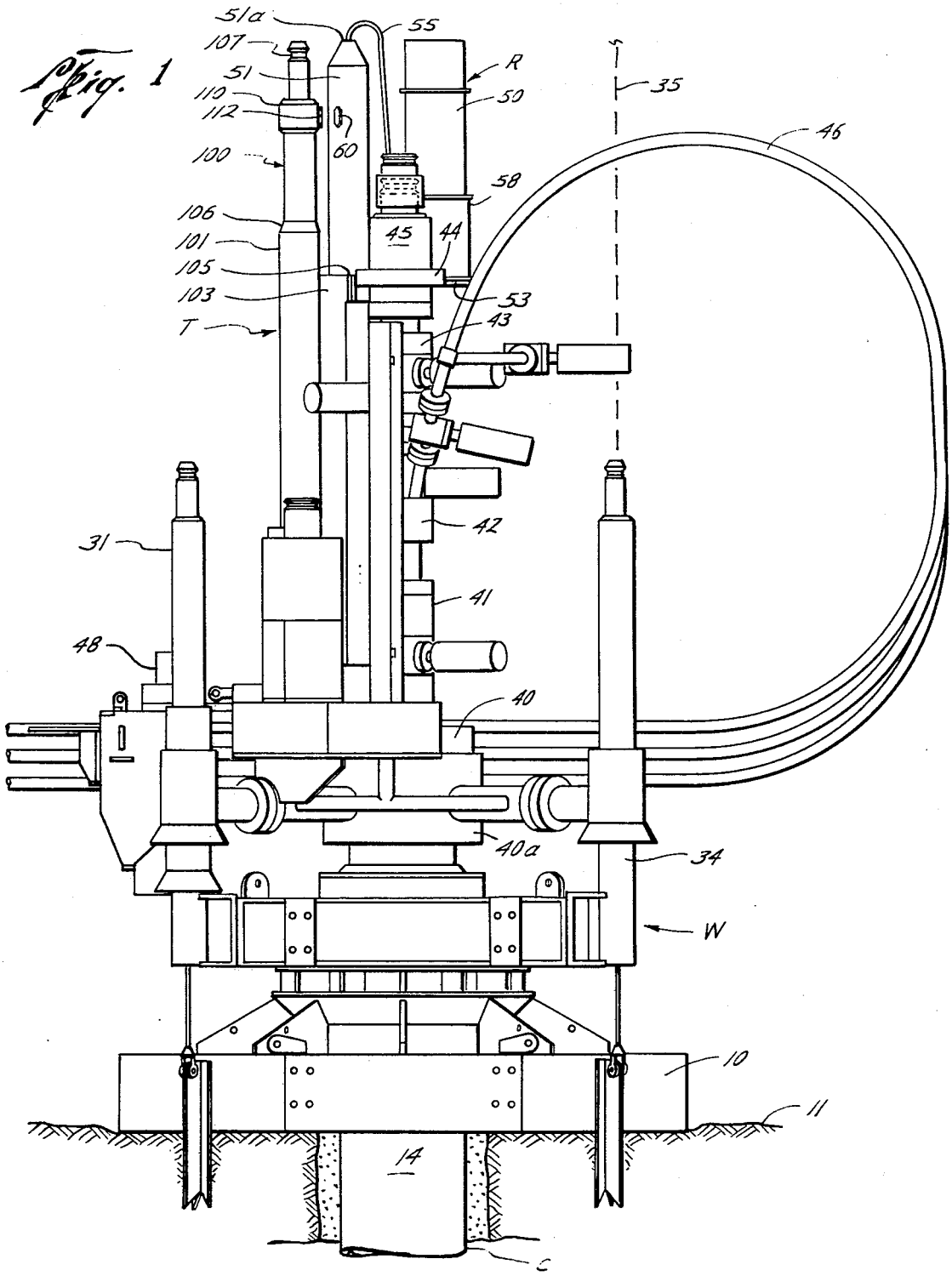
FIG. 1 is an elevation view of a sub-sea wellhead and christmas tree positioned on the ocean floor.

The re-entry guidance apparatus of the present invention, designated generally R in FIG. 1 of the drawings, is used in guiding re-entry into a well, designated generally W, for maintenance and remedial on the well.

As shown in FIG. 1 of the drawings the underwater wellhead includes the temporary guide base 10 which is positioned on the ocean floor 11 adjacent the upper end of the well bore 14. The temporary guide base functions both as an anchor for the guideline cables and also as support base for the permanent guide structure 16. As shown, several strings of casing, indicated generally C, extend downwardly into the well bore 14 from the guide structures. It will be appreciated that the number and size of the various casing strings as well as the tubing strings vary from well to well.

Figure 2:
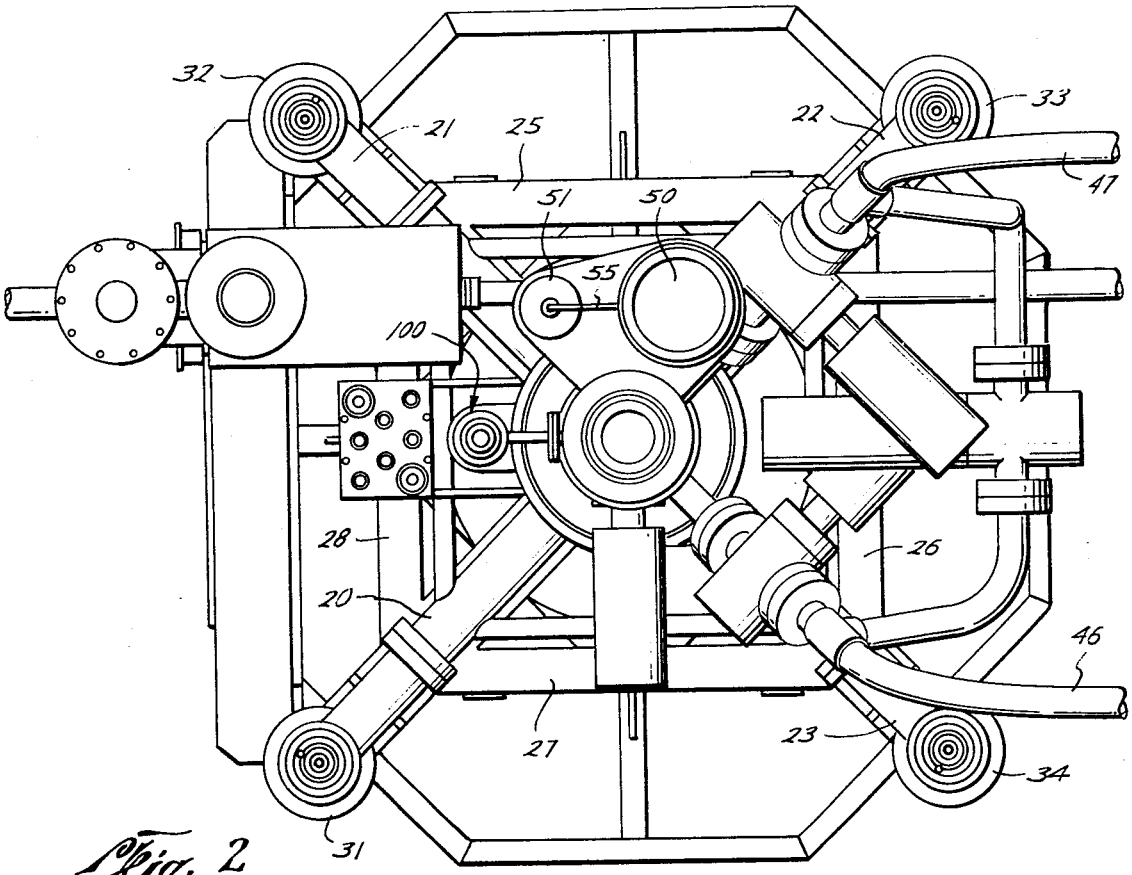
FIG. 2 is a plan view of the wellhead and christmas tree shown in FIG. 1 with the control pod in an alternate position.
Figure 3:
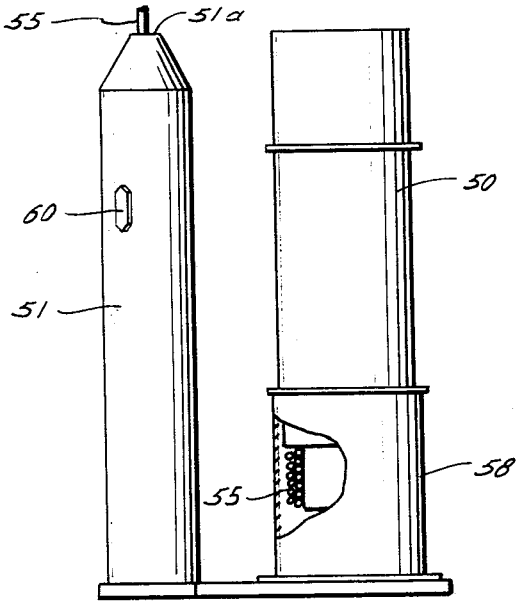
FIG. 3 is an enlarged elevational view of the releasable buoy and buoy post showing further details.

As shown in FIGS. 1 and 2 of the drawings, the permanent guide structure 16 includes four radially extending beam members 20, 21, 22 and 23, respectively, which are spaced at 90° intervals around the well. Such beams are joined by transverse support members 25, 26, 27 and 28, respectively.

Four upwardly projecting guide posts 31, 32, 33 and 34 are provided at the outer ends of the radially extending beams 20, 21, 22 and 23, respectively. Guidelines normally extend upwardly from the upper end of each of the guide posts 31, 32, 33 and 34, respectively, in the manner indicated by the dotted line 35, for use in guiding various wellhead structures onto the permanent guide structure. However, when the wellhead has been completely installed and connected to its flow lines, these guidelines are normally removed and no guidelines extend upwardly from the well to the ocean surface.

The purpose of the present invention is to provide a diverless apparatus for re-connecting such guidelines either to a re-entry post near the center of the wellhead or to at least two of the corner guide posts which extend upwardly from the permanent guide base, such as corner posts 31 and 32, for use in subsequent removal of the tree T from the wellhead W, as will be described in detail hereinafter.

As shown in FIG. 1, when completely assembled and installed on the wellhead, a typical stack of underwater completion equipment includes a connector 40 which connects the wellhead W to the production tree T, a master valve 41, a wye spool 42, swab valve 43, manifold 44 which may control the tree T, and tree cap 45. Shown also with the tree are associated flow line loops 46 and 47 as well as a flow line connector 48 which connects the flow lines to a gathering system.

In addition to these conventional wellhead devices, there is shown in FIG. 1 of the drawings a remotely releasable re-entry buoy 50 and a buoy post 51, both of which are mounted on the tree cap 45 by a suitable base plate 53. This arrangement permits removal of the buoy post 51 with the tree cap 45 when the tree cap is pulled after the buoy has been released to the surface, as will be described in further detail.

The re-entry buoy 50 comprises a cylindrical float member having a lightweight guide cable 55 stored on a suitable spool or reel 56 affixed to the lower end of the cylindrical body. Such guide cable 55 is connected at one end to the buoy body and the other end to the top or upper end 51*a* of the buoy post 51. The buoy and buoy post are mounted adjacent to the tree cap and the buoy post projects upwardly above the top of the tree cap. The spool or drum around which the lightweight cable 55 is wound or coiled is normally releasably secured in a cylindrical housing 58 affixed to the buoy base plate 53. The buoy includes a flotation chamber at its upper end which will cause the buoy to float to the surface when released from the housing 53. The means for remotely actuating the release could be either accoustical, hydraulic or electrical, as desired.

The buoy post 51 is provided with an orienting key 60 which cooperates with an internal cam to orient the re-entry funnel in a manner to be described in detail hereinafter.

Figure 5:
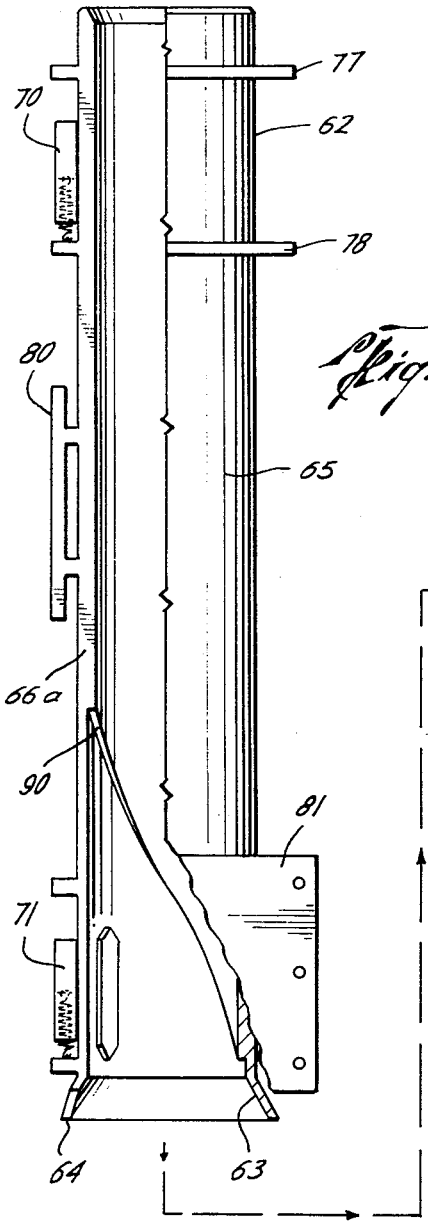
FIG. 5 is an elevation view, partly cut away, showing the re-entry funnel.
Figure 7:
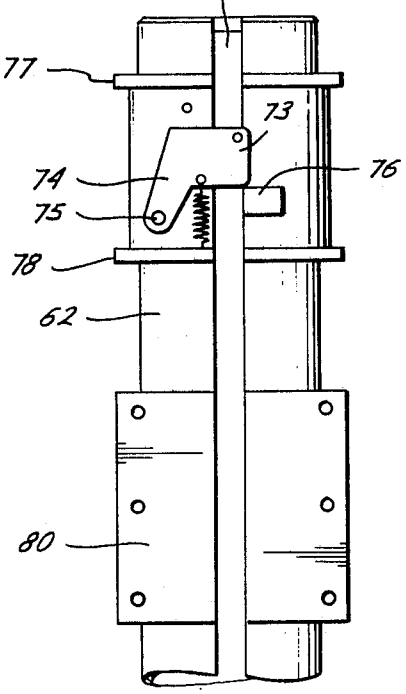
FIG. 7 is a partial enlarged side elevation of the re-entry funnel showing the slot latch.

FIG. 5 shows the re-entry funnel which can be run on the lightweight buoy connecting line or cable 55 to the buoy post 51 or, which can be run on a heavier guideline to the re-entry post, as will be described in detail hereinafter. As shown, the re-entry funnel comprises a longitudinally extending hollow tubular member 62 having an outwardly flared annular skirt 63 at its lower end. Such flared annular skirt 63 forms an outwardly tappered throat with an opening at its lower end 64 of larger diameter than the inside diameter of the opening or passage 65 extending through the re-entry funnel body 62. A longitudinally extending slot 66 is provided in one side of the tubular housing 62 to permit the funnel to be positioned around a cable or guideline such as the buoyline 55 by slipping the tubular funnel body sideways onto such cable or guideline. A pair of cable slot latches 70 and 71 are provided for closing portions of the longitudinally extending slot 66 to prevent the funnel from becoming inadvertently dislodged from the cable on which it is being run during operation. As the upper and lower latch members 70 and 71 are identical, only the upper latch member will be described in detail. As shown in FIG. 7, the upper latch 70 includes a closure arm portion 73 which is carried on a pivot arm 74. A pivot pin 75 mounts the latch on the funnel body 62. When in closed position as shown in FIG. 7, the latch closure arm 73 extends transversely of the slot 66 and engages a stop 76.

A pair of circumferentially extending flanges or projections 77 and 78 are provided adjacent to the latches 70 and 71 to protect them from being struck or damaged or inadvertently opened. A spring 79, connected to the latch 70, and the guard ring 78 releasably hold the latch in the closed position. These latches allow positive retention of the guideline in the re-entry funnel during running and allow swivel capability for transportation down the guideline and orientation about the re-entry post or buoy post as will be explained.

Figure 6:
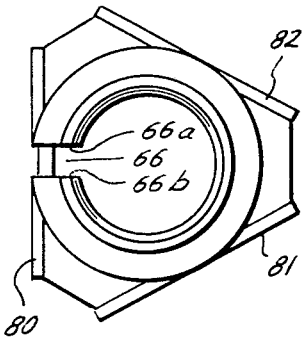
FIG. 6 is a top view of the re-entry funnel showing the orienting faces.

Further, as shown in FIG. 6 three circumferentially positioned faces or flanges 80, 81 and 82 are secured to the funnel body 62. These faces are provided for mounting various re-entry tools which will be described in detail hereinafter.

The re-entry funnel is provided with an internal helical cam 90 which engages the key 60 on the buoy post 51. The helical cam 90 engages the key 60 as the re-entry funnel moves downwardly over the buoy post and rotates or swivels the funnel so as to align the key 60 with the slot 66 in the funnel body 62. With the funnel body 62 thus aligned, the faces 80, 81 and 82 are oriented precisely for alignment with various parts of the wellhead, as will be described.

Such helical shoulder or cam extends from one edge 66*a* of the slot 66 to the opposite edge 66*b* so as to rotate the re-entry funnel body 62 and align the slot 66 with the key 60 regardless of the orientation of the re-entry funnel relative to the key when the funnel is lowered onto the buoy post 51.

The re-entry funnel is also adapted to operate on a re-entry post assembly 100 shown in FIGS. 1 and 2 of the drawings. The re-entry post assembly 100 comprises a circular post 101 which is positioned near the centerline of the tree and midway between the guide posts 31 and 32. The lower end of the re-entry post is attached to the tree at the tree guide frame 40*a* and the upper end is connected to the manifold 44. The upper end of the re-entry post preferably projects above the tree to an elevation approximately the same as that of the buoy post 51.

The re-entry post 101 extends down in the tree as far as possible with a gusset or web 103 extending adjacent the manifold down to a position adjacent to top of the connector 40. Thus, the web extends substantially the full length of the post body 101. A flange member 105 is provided at the upper end of the gusset 103 for connection to the manifold body 44. The re-entry post 101 is tapered to a reduced diameter portion 106 which extends from above the top of the gusset 103 to an enlarged collar 110 on which an orientation key 112 is mounted. The orientation key 112 cooperates with the helical cam 90 in the re-entry funnel to align the funnel relative to the gusset 103 on the re-entry post 101.

As shown in FIG. 1, the orientation key 112 is aligned with the gusset 103 to allow the oriented re-entry funnel to travel downwardly along the re-entry post in the area of the gusset 103. The top of the re-entry post is provided with a reduced diameter neck portion 107 for receiving a releasable detent connector for attaching a remote guideline connector to the top of the re-entry post. A connector such as the remote guideline connector made by VETCO OFFSHORE, Inc. of Ventura, California, provides a suitable connector for connecting a cable to the top of either the re-entry post 101 or to the top of one of the corner guide posts 31 or 32.

Figure 4:
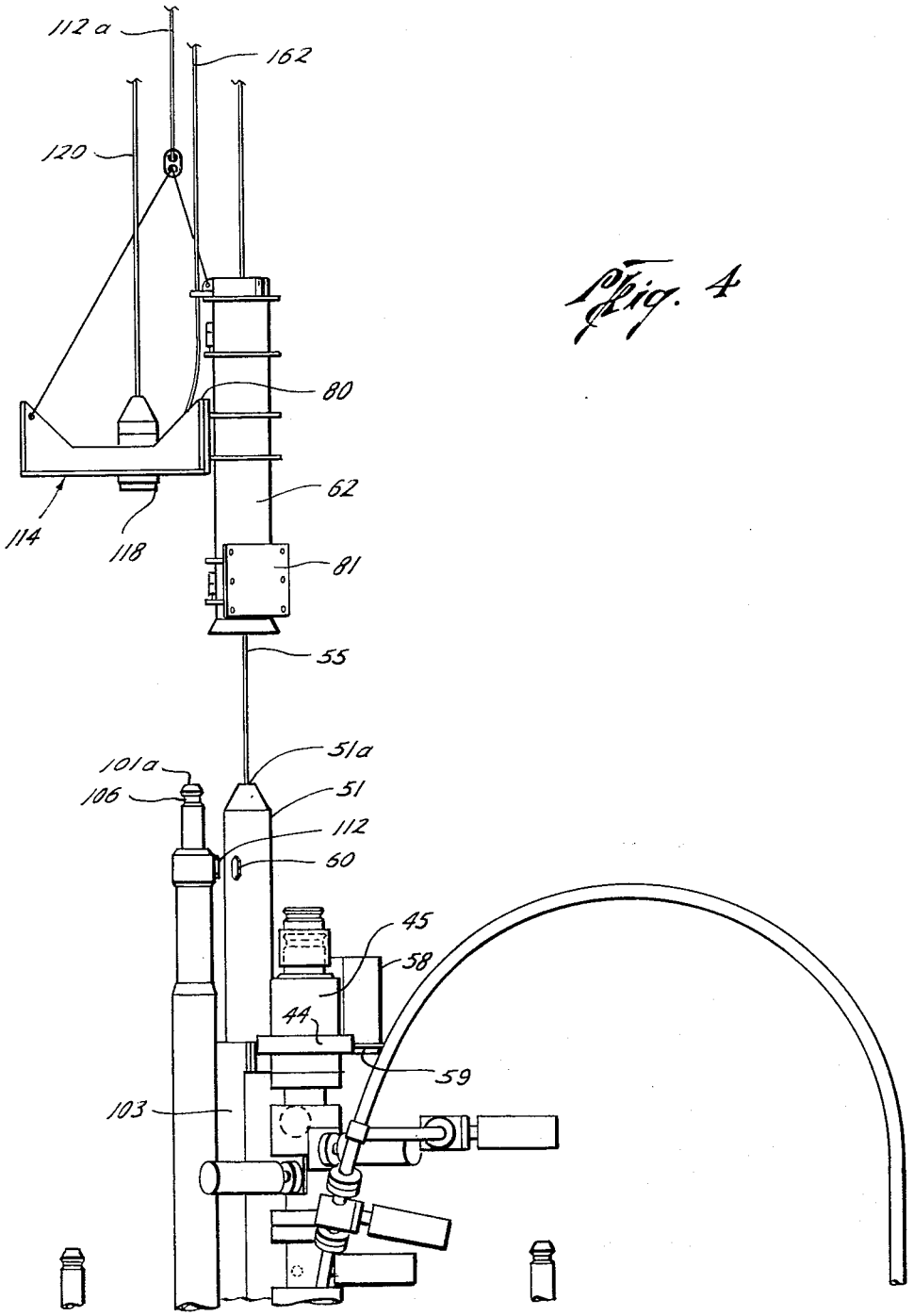
FIG. 4 is an elevation showing a guideline being connected to one of the re-entry posts on the well structure.

FIG. 4 shows that the buoy 50 has been released from its support 53 and that the buoyline 55 extending to the surface provides an initial re-entry guide for the re-entry funnel 62 as it is lowered towards the buoy post 55 by a liftline 112*a*. A guideline connector installation arm 114 is shown attached to the plate or face 80 on the funnel 62. When the funnel 62 is properly oriented on the buoy post 51 by the orientation key 60, the guideline connector 118, carried by the guideline connector arm 114, will be aligned with the upper end 101*a* of the re-entry post. As shown, the guideline connector 118 is affixed to a guide cable 120 and will connect such cable to the upper end of the re-entry post 101 when lowered into place thereon. Such guideline connector includes a plurality of releasable detents which unlock a lock ring and allow the connector to be lowered onto the upper end of the re-entry post 101. With the guideline connector 118 aligned with the reduced diameter neck portion 106, the biased detents are released locking the guideline connector 118 to the top of the re-entry post 101.

After the guideline connector has been connected to the upper end of the re-entry post 101, such guideline connector 118 is released from the guideline installation arm 114 whereupon the re-entry funnel 62 and the guideline connector arm 114 will be retrieved to the surface.

Figure 11:
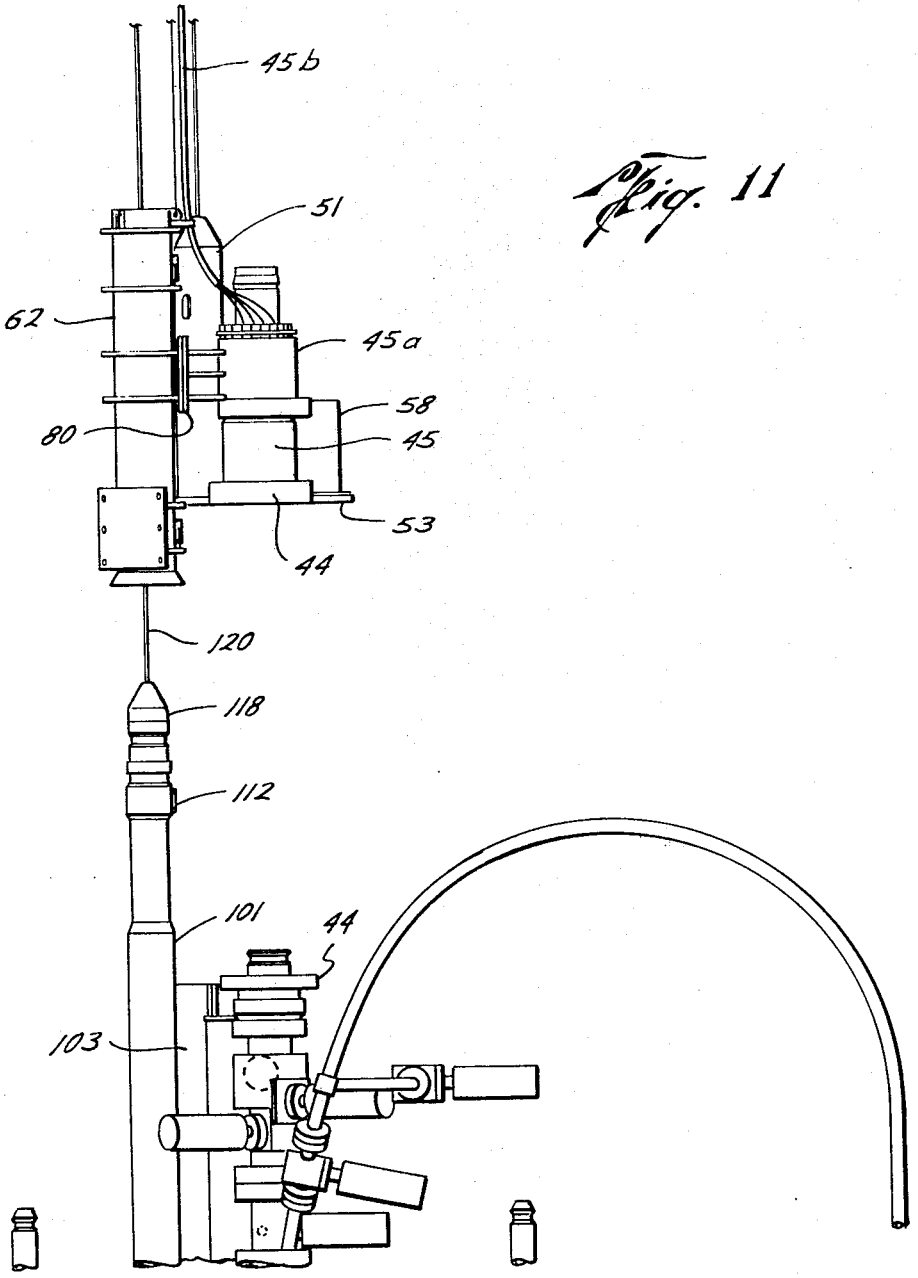
FIG. 11 is an elevation view showing a tree running tool removing the tree cap from the christmas tree.

After the guideline connector 118 has been connected to the re-entry post 101, the tree cap 45 together with the buoy guide post 51 and the buoy container 58 are removed to the surface where the buoy guideline cable 55 is rewound on the spool or drum attached to the lower end of the buoy and the buoy thereafter is reset in the container 58. As shown in FIG. 11 of the drawings, the re-entry funnel 62 can also be used for mounting the tree running tool 45*a* which is used for removing the tree cap 45 from the uppermost part of the completion tree. As shown, the tree running tool 45*a* is mounted on the plate or face 80 on the re-entry funnel 62 and when the re-entry funnel 62 is aligned with the key 112 the tree running tool 45*a* will be positioned in alignment with the top of the tree cap 45. Thereafter, the tree running tool 45*a* carrying the tree cap 45, the buoy and buoy post are returned to the well structure via the guideline 120 and the tree cap is reinstalled on the manifold 44 at the upper end of the tree.

Figure 8:
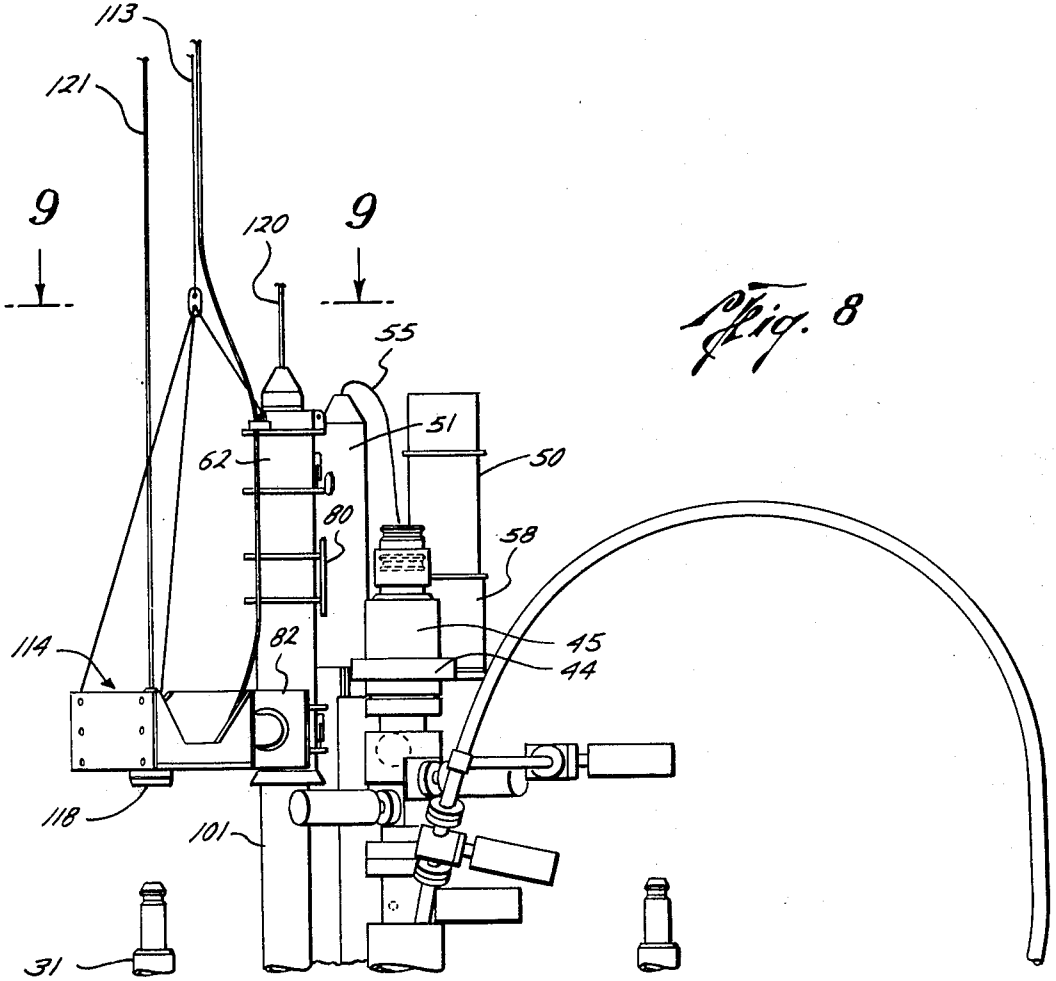
FIG. 8 is a side elevation view of a guideline connector installation arm positioning a guideline connector over a guide post.

FIG. 8 shows the tree with the re-entry buoy 50 returned to its canister or holder 58 and with the tree cap 45 reinstalled atop the manifold 44. Further, the buoy post 51 is returned to its original FIG. 1 position mounted adjacent to the manifold 44 with the buoy cable 55 shown extending from the top of the buoy post to the lower portion of the buoy 50. Further, as shown in FIG. 8, the guideline 120 is connected to the upper end of the re-entry post 101.

In the FIG. 8 illustration the guideline connector installation arm 114 is shown connected to one of the lower mounting plates 82 affixed to the lower end of the re-entry funnel 62. The re-entry funnel 62 and the guideline connector installation arm 114 are shown carried by a line or cable 113 which is used to raise and lower this assembly on the guideline 120. A guideline connector 118 is shown carried by the guideline connector installation arm 114 and aligned above the upper end of the permanent guide post 31. A standard guideline 121 is shown connected to the guideline connector 118 which will connect such guideline 121 to the upper end of the permanent guide post 31. This connection will be substantially identical to the connection of the guideline 120 to the upper end of the re-entry post 101.

Figure 9:
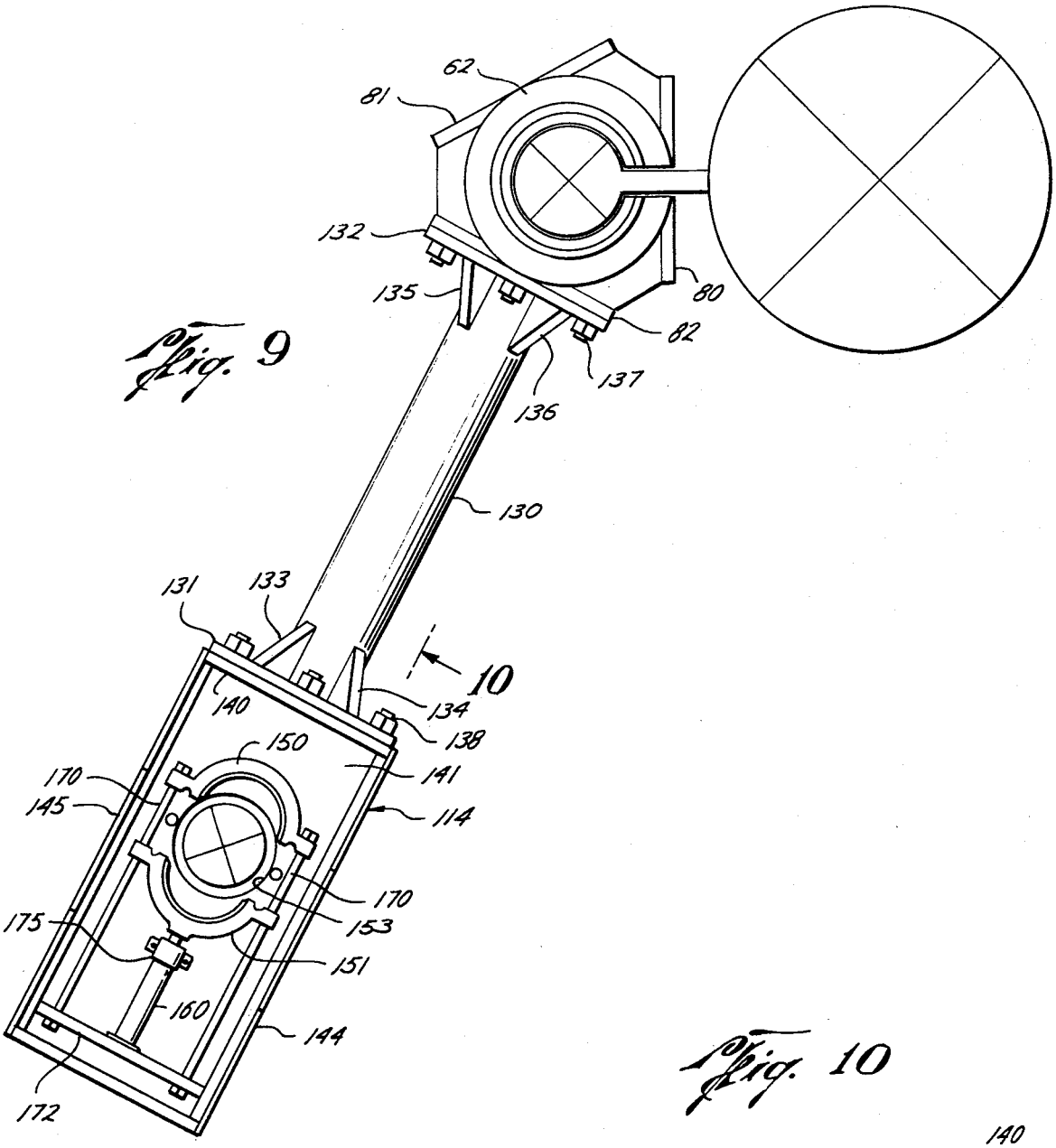
FIG. 9 is a partial section taken on line 9—9 of FIG. 8 showing a top view of the installation arm.

As shown in FIG. 9 of the drawings, the remote guideline connector arm 114 is mounted on an extension arm 130 which is bolted to the face or plate 82 carried on the re-entry funnel 62. In the preferred form of this invention, the extension arm 130 comprises a tubular strut or member having flanges 131 and 132, respectively, welded at opposite ends of such strut 130. As shown, gussets or reenforcing angle members 133, 134, 135, 136 are welded to the strut 130 and also to the flange members 131 and 132, respectively. A plurality of bolts 137 secure the plate 132 to the face 82 and similarly, a plurality of bolts 138 secure the plate 131 to the endplate 140 of the guideline connector installation arm 114.

Figure 10:
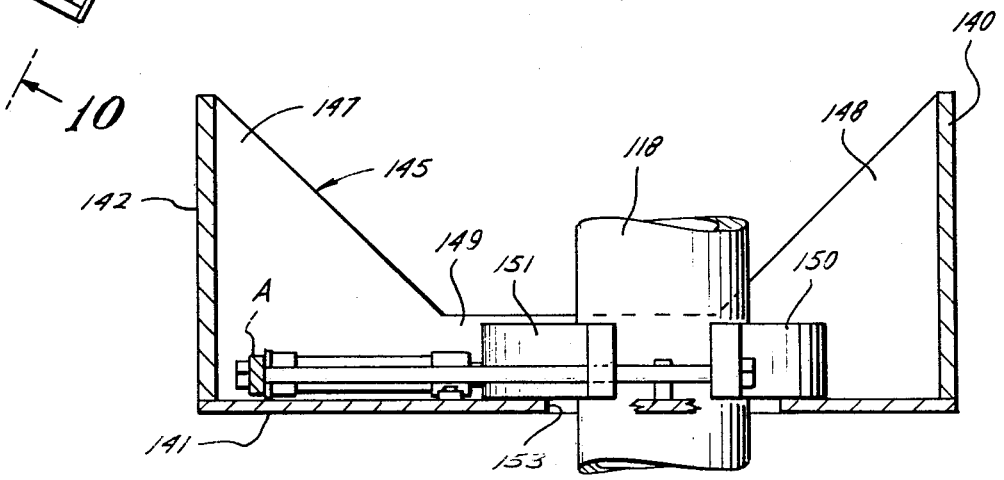
FIG. 10 is a sectional view taken on line 10—10 of FIG. 9 showing additional details of the installation arm.

As best seen in FIGS. 9 and 10, the guideline connector installation arm 114 includes a horizontally disposed bottom member 141, having an opening 153 therethrough for receiving the guideline connector 118. Also, such connector arm includes a pair of upstanding endpieces 140 and 142 which are welded or otherwise secured to the bottom member 141. Further, side members 144 and 145, respectively, are also secured to the opposite edges of the bottom member 141 as well as to the upstanding end members 140 and 142. As shown in FIG. 10, the side member 145 (which is identical to the corresponding side member 144) comprises a longitudinally extending plate having inwardly and downwardly tapered end portions 147 and 148 adjacent the opposite upstanding the ends 142 and 140 for strengthening the installation arm 114. Such tappered endportions 147 and 148 are joined by a longitudinally extending center portion 149 which extends upwardly above the bottom 141 to a height above the corresponding clamp members 150 and 151, respectively.

As shown in FIGS. 9 and 10, the guideline installation arm 114 includes a pair of opposed hydraulically actuated clamp members 150 and 151 which are positioned on opposite sides of an opening 153 in the bottom 141, in which a guideline cable connector 118 is positioned. The clamps 150 and 151 are opposed C-shaped clamp members facing each other on opposite sides of the opening 153. Such clamps are hydraulically actuated by a piston (not shown) which moves in a cylinder 160 that is mounted on the installation arm 114 and which is supplied by hydraulic fluid through a hydraulic hose 162 that extends upwardly to the surface for actuation remotely from the guide line connector installation arm.

At the surface, the clamp jaws 150 and 151 are closed on the guideline connector 118 so as to depress the releasable detents and unlock the latch mechanism in the connector. After the guideline connector has been positioned over the top of the permanent guide post 31, the hydraulic piston is moved in the direction indicated by the arrow 165 in FIG. 9, thus moving the clamp member 151 attached thereto in the same direction and out of engagement with the guideline connector 118. Simultaneously, the hydraulic fluid in the cylinder 160 causes such cylinder to react and move toward the guideline connector 118. The clamp, 150 which is attached to the cylinder 160 by means of the rods 170 and cross-piece 172 also moves in the same direction which is opposite to the direction indicated by arrow 165 thus moving the clamp 150 out of engagement with the guideline connector 118. The guide 175 which is secured to the bottom 141 guides the cylinder 160 and keeps it aligned with respect to the opening 153. Also, as shown in FIGS. 9 and 10, a pair of stop pins 180 and 181 are mounted in the bottom plate 141 on opposite sides of the opening 153. Such pins are received in the openings 190 and 191 on the opposite ends of the jaws or clamp members 150 and 151 to stop the jaws in the closed position on the guideline connector 118.

After the guideline connector is positioned on the top of the permanent guide post 31, the jaws 150 and 151 are retracted, disconnecting them from the guideline connector. Thereafter, the installation arm 114 is lifted with the re-entry funnel 62 and retrieved to the surface.

Figure 12:
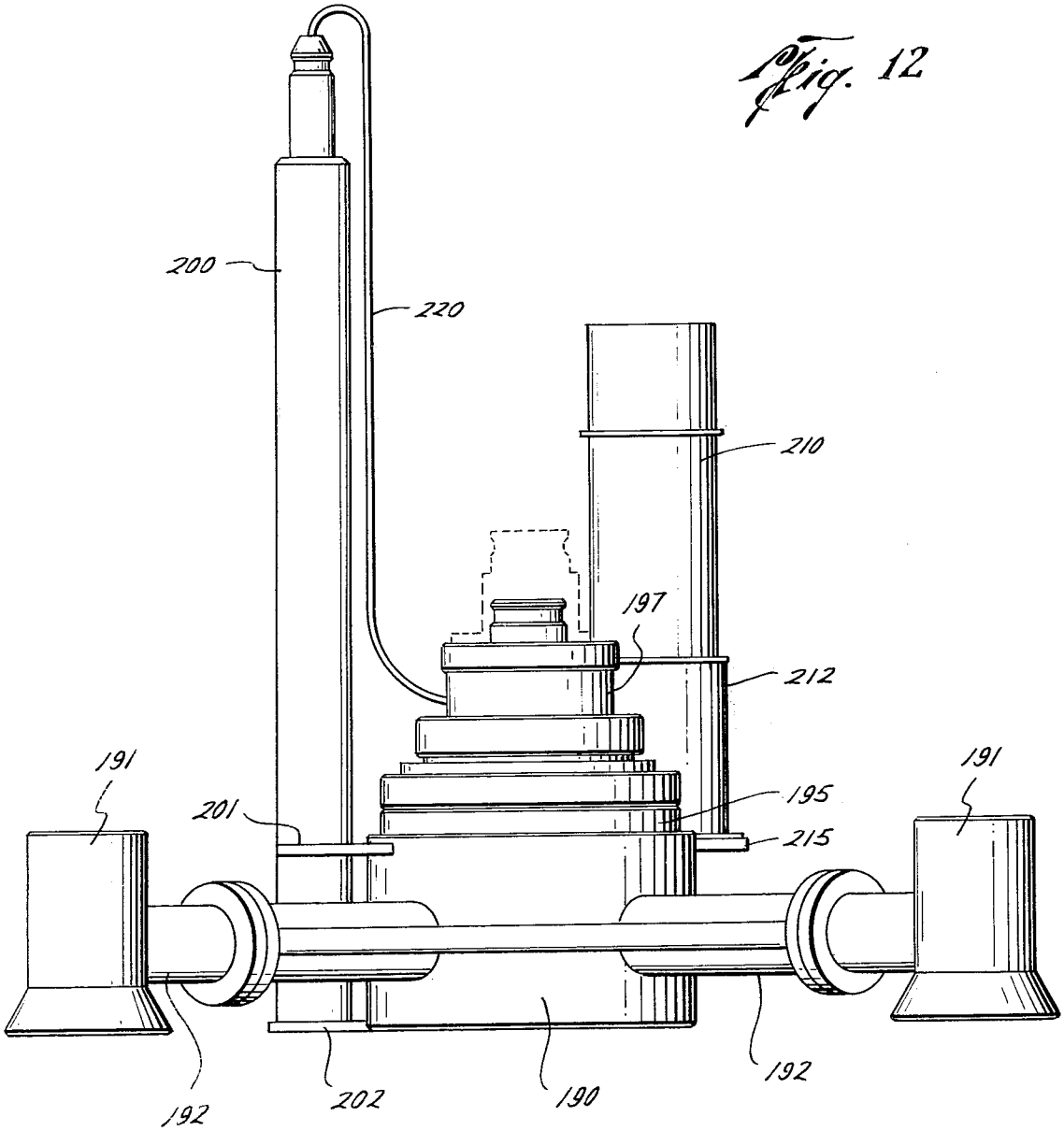
FIG. 12 is an elevation of a wellhead cap with a buoy and buoy re-entry post.

An alternate embodiment of the apparatus of the present invention is illustrated in FIG. 12 which shows a diverless retrievable temporary wellhead cap mounted on a guide frame. The guide frame 190 is normally positioned on a permanent guide structure (not shown) with the permanent guide posts extending upwardly through guide funnels 191 which are carried on radially projecting arms 192 spaced at 90° intervals around the central guide frame housing 190. Such funnels 191 are positioned over the permanent guide posts on the permanent guide structure. As shown, a well connector, such as a VETCO type H-4 hydraulic connector, 195 is mounted in the guide frame 190 and connected to the top of the wellhead (not shown). A wellhead cap 197 is affixed to the top of the connector 195 and is adapted to receive the tree running tool such as illustrated at 45*a* in FIG. 11 of the drawings. Such tree running tool is provided with hydraulic connections which engage the wellhead cap 197 and, when actuated, release the hydraulic connector 195 from the wellhead to permit the guide frame structure to be withdrawn from the wellhead. Such temporary wellhead cap is normally installed after the wellhead has been set and prior to the landing of the christmas tree on such wellhead.

A re-entry post 200 is shown mounted on the guide frame 190 by means of brackets 201 and 202. Such re-entry post 200 is substantially identical to the re-entry post 101 illustrated in FIG. 1 of the drawings. Similarly, a re-entry buoy 210 is shown mounted in a canister or holder 212 that is mounted on the guide frame 190 by means of a supporting bracket 215. Such buoy 210 is connected by means of a cable 220 to the top of the re-entry post 200. It will be appreciated that the buoy 210 is substantially identical to the buoy 50 illustrated in FIG. 1 of the drawings. Such buoy 210 is released from its container 212 by means of a remotely actuated control which permits the buoy 210 to float to the surface of the water body in which the temporary wellhead cap is used. As the buoy 210 floats to the surface the cable 220 is unwound from its storage reel in the buoy 210 so as to provide an initial guideline for guiding a re-entry funnel 62 to the top of the re-entry post 200.

With the tree running tool 45*a* secured to the re-entry funnel 62 in a manner illustrated in FIG. 11 of the drawings, such tree running tool with its associated hydraulic controls may be connected to the upper end of the wellhead cap 197. The hydraulic control line running to the surface permits the connector to be actuated to disconnect the connector 195 from the wellhead for subsequent retrieval of the guide frame 190. Further, it will be appreciated that prior to retrieving the temporary well cap illustrated in FIG. 12 of the drawings, guidelines would be connected to two of the permanent posts (not shown) on the permanent guide structure (not shown) on which the guide frame 190 is positioned. Such guidelines would be connected by use of the re-entry tool in the manner illustrated and described with respect to FIG. 8 of the drawings. After two of the guidelines have been attached to a pair of the permanent guide posts, the guide frame 190 carrying the connector and the wellhead cap could be retrieved along such guidelines to the surface.

Further, it will be appreciated that in the event it became desirable to retrieve the entire tree T, as illustrated in FIG. 1 of the drawings, the guidelines would be connected to two of the guide posts such as 30 and 31 and thereafter the tree running tool 45*a* would be run in the manner illustrated in FIG. 11 to retrieve the tree cap 45. After such tree cap was retrieved to the surface the tree running tool 45*a* would be detached therefrom and thereafter re-run on the cable 120 by the re-entry funnel 62 and connected to the manifold 44. With the manifold thus connected to the hydraulic supply line 45*b* the connector 40 would be released from the wellhead and the flow lines 46 and 47 would be released at the flow line connector 48 to thereby disconnect the tree and its flow lines and permit its retrieval to the surface. Such retrieval would involve lifting of the tree along the guidelines which were connected to the permanent guide posts 31 and 32.

Figure 5A:
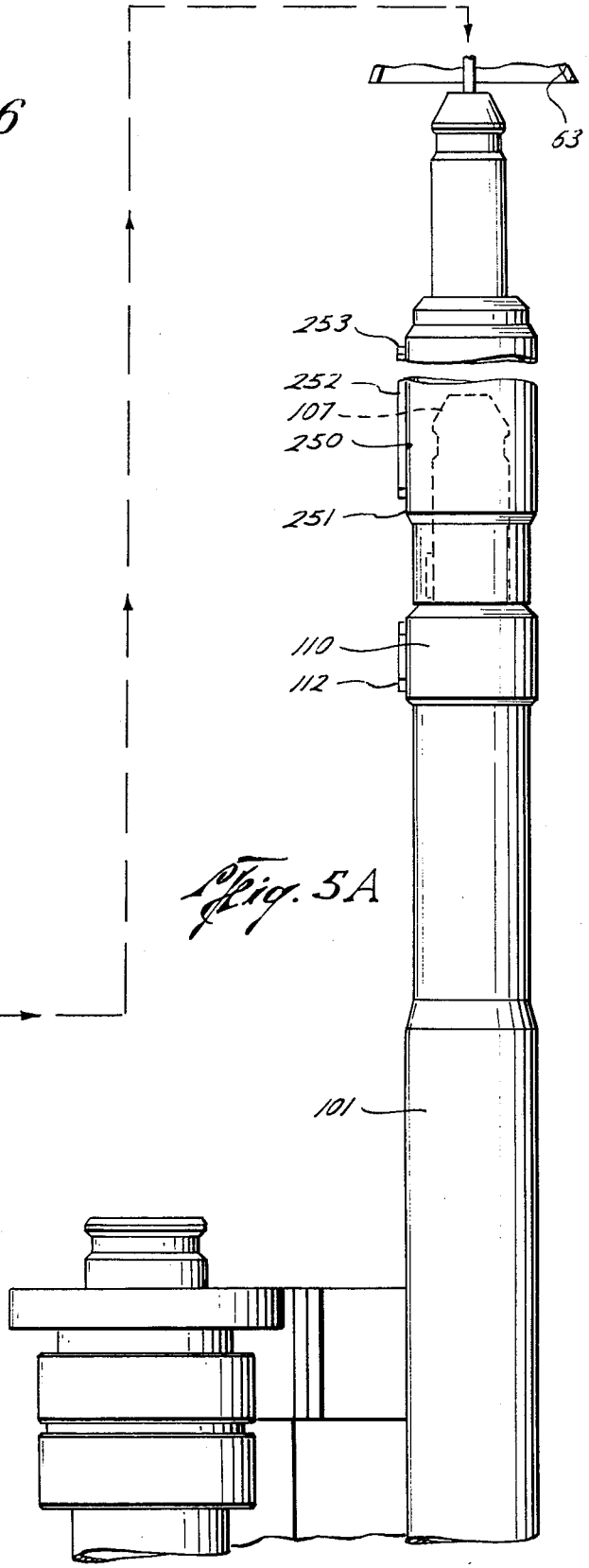
FIG. 5*a* is an elevation view of the re-entry funnel positioned above a re-entry guide post extension.

Another alternate embodiment of the apparatus of the present invention is best illustrated in FIG. 5A of the drawings wherein a re-entry post extension 250 is shown connected to the upper end 107 of the re-entry post 101. Such re-entry post extension is provided for use where the christmas tree is extra tall. As shown in the drawings the tree extension is arranged so that its lower end 251 is positioned over the upper end 107 of the re-entry post 101. The re-entry post extension 250 is provided with a key or guide 252 which is aligned vertically with the key 112 on the re-entry post 101. An upper key 253 is provided near the top of the re-entry post extension 250 for initially aligning the re-entry funnel 62. Such key 253 engages the helical cam 90 in the re-entry 262 and rotates it so as to align the longitudinally extending slot 66 with the key 253 as well as the key 252 and also the key 112 to thereby assure proper orientation of the various tools connected to re-entry funnel 62.

Further, it will be appreciated that in connecting the guidelines to the two permanent guide posts 31 and 32 that a pair of the connectors 114 can be mounted on the re-entry tool 62 to permit simultaneous installation of two guidelines to the two poles on a single trip. In that event, a second strut 130 with its installation arm 114 would be mounted on the face 81 on the re-entry funnel 62 illustrated in FIG. 9 of the drawings.

The foregoing disclosure and description of the invention are illustrative and explanatory thereof, and various changes in the size, shape, and materials as well as in the details of the illustrated construction may be made without departing from the spirit of the invention.

What is claimed is:

1. A re-entry guidance apparatus for guiding a first connecting member into connecting engagement with a second connecting member on a submerged well structure, comprising:

a. a re-entry post extending upwardly from the well structure;

b. a re-entry guideline extendable upwardly from said re-entry post to the water surface;

c. funnel means movable along said guideline to said re-entry post for carrying the first connecting member to the submerged well structure;

d. orienting means on said re-entry post and said funnel means for orienting said funnel means relative to said re-entry post; and e. mounting face means affixed circumferentially about said funnel means for mounting the first connecting member with said funnel means in any of a plurality of preselected positions so that with said funnel means aligned relative to said guide post, the first connecting member is aligned with the second connecting member on the submerged well structure.

2. The apparatus set forth in claim 1, wherein:

the first connecting member is a tree running tool and the second connecting member is a manifold connected to the submerged well structure.

3. The apparatus set forth in claim 1, including:

a re-entry post extension mountable with the top of said re-entry post and extending thereabove, said re-entry post extension including orienting key means alignable with said orienting means on said re-entry post for enabling said funnel means to be guided from said re-entry post extension to said re-entry post.

4. The apparatus of claim 1, including:

remotely releasable buoy means detachably mounted with the submerged well structure for controllably extending said re-entry guideline from said re-entry post to the water surface.

5. The apparatus set forth in claim 2, wherein the submerged well structure includes a christmas tree having a removable tree cap mounted in a manifold on the well structure, and wherein:

said remotely releasable buoy means and said re-entry post are mounted on the removable tree cap, whereby said buoy means, said re-entry post, and said re-entry guideline mounted therewith are removable from the submerged well structure.

6. The apparatus set forth in claim 1, wherein said orienting means includes:

an outwardly projecting key mounted on said re-entry guide post, said key being aligned in a predetermined position relative to the well structure.

7. The apparatus set forth in claim 6, wherein said orienting means further includes:

a longitudinally extending slot in said funnel means for receiving said key and a helical cam extending circumferentially of said funnel means from one edge of said slot to the other edge of said slot for rotating said funnel means relative to said re-entry post to guide said slot onto said key.

8. The apparatus set forth in claim 7, including:

slot latch means on said funnel means for closing at least a portion of said slot to prevent said funnel means from becoming dislodged from said re-entry guideline.

9. The apparatus set forth in claim 8, wherein said slot latch means includes:

a pair of longitudinally spaced latch members biased to a closed position relative to said slot and manually openable to permit inserting of said re-entry guideline into said funnel means to mount said funnel means for movement along said re-entry guideline.

10. The apparatus set forth in claim 1, wherein the submerged well structure includes a christmas tree having a removable tree cap mounted in a manifold on the well structure and further including:

means mounted on said funnel means for connection with the tree cap on the well manifold for disconnecting the tree cap from the manifold.

11. The apparatus set forth in claim 10, wherein:

said means for connection with the tree cap are also connectable with the manifold.

12. The apparatus set forth in claim 1, including:

a second re-entry post mounted on the submerged well structure.

13. The apparatus set forth in claim 12, wherein:

the first connecting member is a remote guideline connector connected to said guideline and the second connecting member is said second re-entry post on the submerged well structure.

14. The apparatus set forth in claim 13, including:

guideline connector latch means mounted with said guideline connector for controllably locking said guideline connector to an upper end of said second re-entry post and means for holding said guideline connector latch means in an unlocked position and for releasing said guideline connector latch means to lock said guideline connector to the upper end of said second re-entry post.

* * * * *